US006906454B2

(12) United States Patent
Oh et al.

(10) Patent No.: US 6,906,454 B2
(45) Date of Patent: Jun. 14, 2005

(54) SHADOW MASK FOR CATHODE RAY TUBE

(75) Inventors: Hyung-Seok Oh, Suwon (KR); Dong-Hwan Kim, Suwon (KR)

(73) Assignee: Samsung SDI Co., Ltd., Suwon (KR)

( * ) Notice: Subject to any disclaimer, the term of this patent is extended or adjusted under 35 U.S.C. 154(b) by 180 days.

(21) Appl. No.: 10/601,239

(22) Filed: Jun. 20, 2003

(65) Prior Publication Data

US 2004/0061424 A1 Apr. 1, 2004

(30) Foreign Application Priority Data

Sep. 26, 2002 (KR) ..... 10-2002-0058395

(51) Int. Cl.[7] ..... H01J 29/80
(52) U.S. Cl. ..... 313/402; 313/403; 313/407; 313/408
(58) Field of Search ..... 313/402, 403, 313/407, 408

(56) References Cited

U.S. PATENT DOCUMENTS 5,606,217 A * 2/1997 Hirai et al. ..... 313/477 R
2001/0011864 A1 * 8/2001 Nose et al. ..... 313/407

FOREIGN PATENT DOCUMENTS

JP 2001-319600 11/2001

OTHER PUBLICATIONS

Patent Abstract of Japan, Publication No. 2001–319600, Published on Nov. 16, 2001, in the name of Watanabe Mitsuru, et al.

* cited by examiner

*Primary Examiner*—Ashok Patel
*Assistant Examiner*—Anthony Canning
(74) *Attorney, Agent, or Firm*—Christie, Parker and Hale, LLP

(57) ABSTRACT

A shadow mask includes an aperture area having a plurality of apertures through which electron beams pass; a non-aperture area extending a from a circumference of the aperture area; and a skirt formed extending from an outer circumference of the non-aperture area at a predetermined angle, wherein the front surface of the aperture area is formed satisfying the following conditions, $$100\% < RMV'/RMV < 110\%$$

$$120\% < RMS/RMV' < 150\%$$

where RMV is a vertical radius of curvature of the front surface of the aperture area with respect to a vertical direction passing through a center of the aperture area, RMS is a vertical radius of curvature with respect to a short side of the aperture area, and RMV' is a vertical radius of curvature of the front surface of the aperture area with respect to the vertical direction at a location on a horizontal axis passing through the center of the aperture area.

6 Claims, 3 Drawing Sheets

SHADOW MASK FOR CATHODE RAY TUBE

CROSS REFERENCE TO RELATED APPLICATIONS

This application claims priority to and the benefit of Korean Patent Application No. 2002-0058395 filed on Sep. 26, 2002 in the Korean Intellectual Property Office, the entire disclosure of which is incorporated herein by reference.

BACKGROUND OF THE INVENTION (a) Field of the Invention

The present invention relates to a shadow mask for a cathode ray tube. More particularly, the present invention relates to a shadow mask for a cathode ray tube, which is large and has a panel with a flat front surface, and to a cathode ray tube having such a shadow mask.

(b) Description of the Related Art

A cathode ray tube (CRT) is used as an image device for a television, computer monitor, etc. A shadow mask used in a CRT performs a color selection function, in which selection of electron beams emitted from an electron gun is performed so that the electron beams land correctly on a phosphor surface. The shadow mask is structured corresponding to a basic size and shape of a front glass panel of the CRT. Shadow masks also typically have a radius of curvature of approximately R=2,000 mm.

In response to consumer demand, CRTs are becoming larger in size and are formed having a flatter front panel surface. The shadow mask used in such CRTs must undergo corresponding changes in dimension and shape. That is, in large-size CRTs that use a panel with a flat outer surface and a curved inner surface, a shadow mask is used that corresponds to the size of the panel and that is curved similarly to the same.

However, the shadow mask becomes structurally weak if it is made to a large size and having a large radius of curvature, leading to various problems. For example, if a radius of curvature of the shadow mask is made to 1.6R, the shadow mask is unable to easily maintain its shape in the event the shadow mask receives a certain level of shock. Such deformation of the shadow mask greatly reduces the quality of the CRT.

Further, when the shadow mask is large and has a flattened curvature, the shadow mask becomes susceptible to howling. That is, in the case where the CRT is used in a large color television, the shadow mask of the CRT vibrates from the sound generated by the speakers of the television. With the increased size of the shadow mask, it becomes structurally weak as described above such that the shadow mask is more prone to howling.

In order to make the shadow mask resistant to physical shock, various approaches are being used, such as the curved surface of the shadow mask being formed in a long axis direction and a short axis direction satisfying specific equations, and the shadow mask being formed with certain limitations with respect to the radius of curvature in the long and short axis directions. Examples of CRTs utilizing such configurations include the CRT disclosed in U.S. Pat. No. 5,606,217 and the CRT disclosed in Japanese Laid-Open Patent No. 2001-319600.

Further, a thickness of the panel to which the shadow mask is mounted is adjusted to enhance shock characteristics of the shadow mask. In particular, peripheral portions of the panel are made greater in thickness than a center portion of the same (approximately two times thicker or more), and the shadow mask is formed having a corresponding curvature, thereby minimizing damage that may be caused by external shock. However, by this formation of the panel in which the peripheral portions are made thicker than the center portion thereof, the overall weight of the CRT increases. This makes manufacturing of the CRT more difficult and may inconvenience users when moving the display system that includes the CRT.

In addition, if an optimum thickness ratio between the center and periphery of the panel while considering the shock characteristics of the shadow mask cannot be obtained. That is, if the thickness at peripheries is too large compared to the thickness of the center portion of the panel, it becomes necessary to form a coating film, which adjusts transmissivity, on a front surface of the panel in order to prevent deterioration of contrast characteristics of the CRT caused by the transmissivity of the glass forming the panel. This extra step of forming the coating film complicates the overall manufacturing process, ultimately increasing CRT unit costs.

SUMMARY OF THE INVENTION

In one embodiment, the present invention is a shadow mask for a cathode ray tube that has an optimal radius of curvature for minimizing the effect of receiving an external shock, even when used in a cathode ray tube that is large and has a panel with a flat front surface. The present invention also provides a cathode ray tube employing such a shadow mask.

In one embodiment, the shadow mask includes an aperture area having a plurality of apertures formed therein through which electron beams pass; a non-aperture area extending a predetermined distance from a circumference of the aperture area; and a skirt formed extending a predetermined distance from an outer circumference of the non-aperture area at a predetermined angle to the aperture area and the non-aperture area. The front surface of the aperture area of the shadow mask is formed satisfying the following conditions:

$$100\% < RMV'/RMV < 110\%$$

$$120\% < RMS/RMV' < 150\%$$

where RMV is a vertical radius of curvature of the front surface of the aperture area with respect to a vertical direction passing through a center of the aperture area, RMS is a vertical radius of curvature of the front surface of the aperture area with respect to a short side of the aperture area, and RMV' is a vertical radius of curvature of the front surface of the aperture area with respect to the vertical direction at a location on a horizontal axis passing through the center of the aperture area.

Using a horizontal length from a center of the aperture area to an end of the short side of the aperture area as a basis, RMV' is positioned at a specific location between a ⅓ point and a ⅔ point of this horizontal length from the center of the aperture area to the edge of the same. Preferably, RMV' is positioned at substantially a ½ point with respect to the horizontal length.

In one embodiment, the present invention is a cathode ray tube including a panel with an outer surface that is substantially flat and an inner surface that is curved, a phosphor screen being formed on the inner surface; a funnel connected to the panel and including a deflection yoke that is mounted to its outer circumference; a neck connected to the funnel and including an electron gun that is mounted therein, the electron gun generating electron beams; and the shadow mask as described above, the shadow mask being positioned inwardly from the panel and performing color separation of the electron beams emitted from the electron gun.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION

Figure 1:
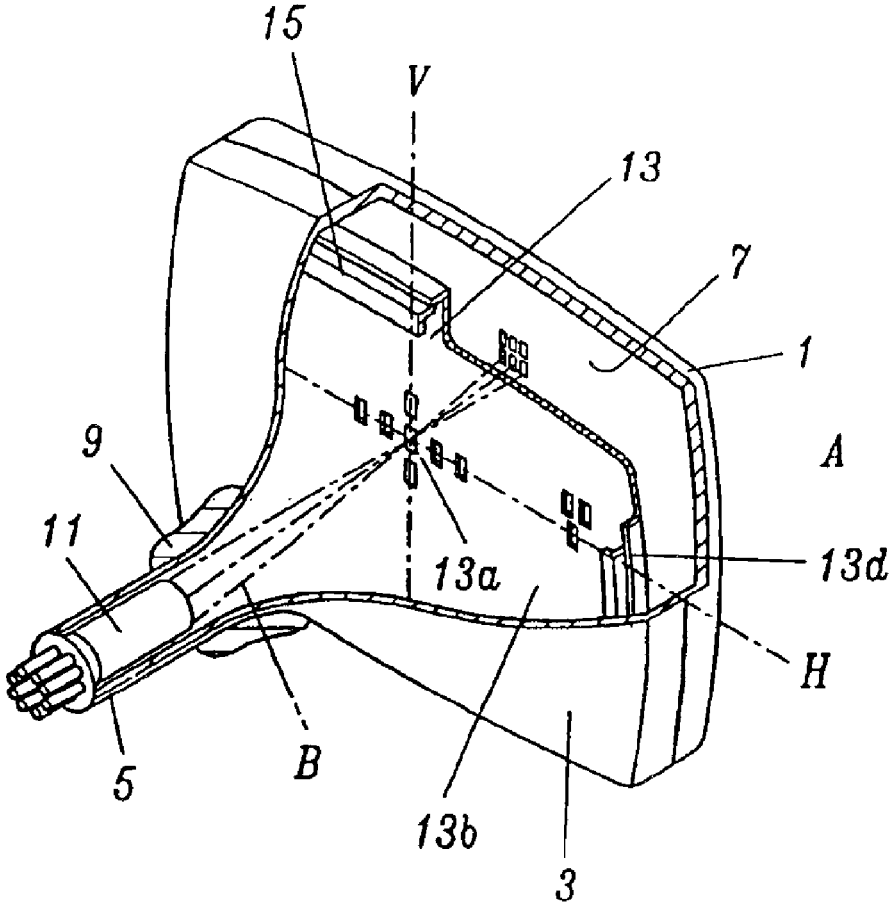
FIG. 1 is a partially cutaway perspective view of a cathode ray tube according to one embodiment of the present invention.

FIG. 1 is a partially cutaway perspective view of a cathode ray tube according to an embodiment of the present invention. As shown in the drawing, an exterior of the cathode ray tube (CRT) is defined by a panel 1, a funnel 3, and a neck 5, which are made of a glass material and fused into an integral, tube-like structure.

Figure 2:
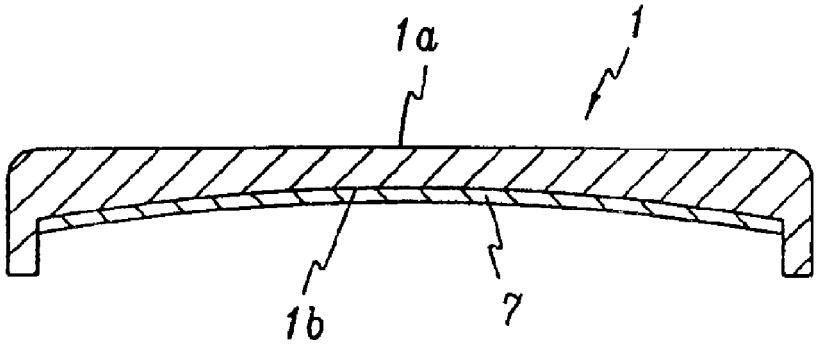
FIG. 2 is a sectional view of a panel of FIG. 1.

The panel 1 is substantially rectangular and a phosphor screen 7 is formed on an inner surface of the panel 1. The phosphor screen 7 includes a phosphor layer in a dot or striped pattern. With reference to FIG. 2, an outer surface 1*a* of the panel 1 is substantially flat, while an inner surface 1*b* of the panel 1 has a predetermined radius of curvature. In the case where the CRT is used as an image device for a display system such as a color television, such a shape of the panel 1 allows for realization of a picture with an exceptional three-dimensional and flat feel.

The funnel 3 fused to the panel 1 is, as its name suggests, funnel-shaped. A deflection yoke 9 is mounted at a predetermined location on an exterior of the funnel 3, and an electron gun 11 is mounted within the neck 5, which is fused to the funnel 3. The electron gun 11 emits three electron beams B and the deflection yoke 9 forms a magnetic field to deflect the electron beams B.

Figure 3:
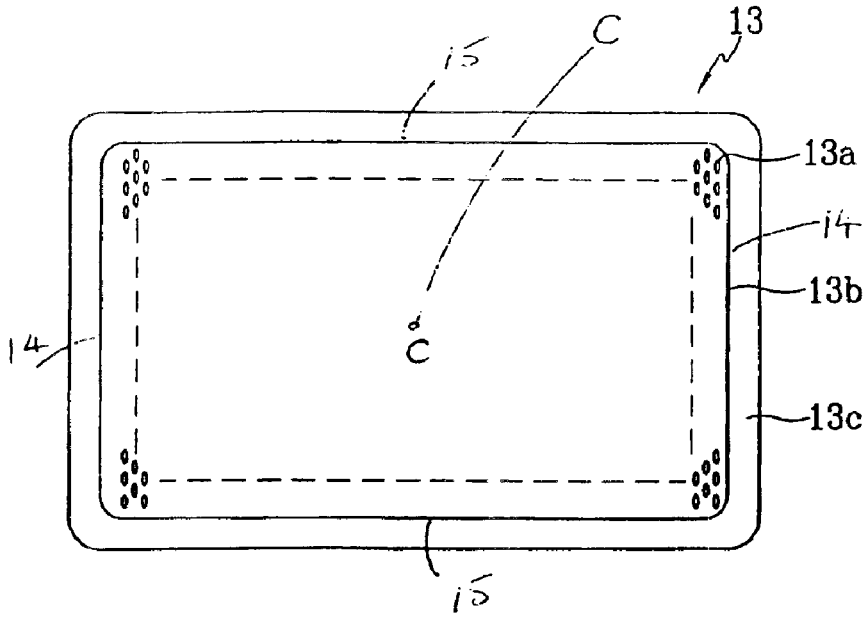
FIG. 3 is a plan view of a shadow mask of FIG. 1.

Further, a shadow mask 13, which acts as a color separation apparatus in the CRT, is mounted inwardly from the panel 1 (a predetermined distance toward the electron gun 11) by being supported by a mask frame 15. The shadow mask 13, with reference also to FIG. 3, includes an aperture area 13*b* having formed therein a plurality of apertures 13*a* through which the electron beams B pass. In order to simplify FIG. 3, all of the plurality of apertures 13*a* through out the aperture area 13*b* are not shown. The shadow mask 13 also includes a non-aperture area 13*c* extending a predetermined distance from a circumference of the aperture area 13*b*, and a skirt 13*d* that is formed extending a predetermined distance from an outer circumference of the non-aperture area 13*c* in a direction substantially perpendicular to the aperture area 13*b* and the non-aperture area 13*c*. The portion of the shadow mask 13 formed by the aperture area 13*b* and the non-aperture area 13*c* is substantially rectangular having two short side 14 and two long sides 15. Also, the aperture area 13*b* has a predetermined radius of curvature that substantially corresponds to the shape of the inner surface 1*b* of the panel 1.

In the CRT structured as in the above, the three electron beams B (red, green, and blue electron beams) emitted from the electron gun 11 are deflected by the deflection yoke 9 in a horizontal direction (or long axis direction) H and a vertical direction (or short axis direction) V of the panel 1 such that the three electron beams B converge onto a single aperture 13*a* of the shadow mask 13. The electron beams B then pass through the aperture 13*a* to land on a desired phosphor of the phosphor screen 7 to illuminate the same. This process is repeated in a process of scanning the phosphor screen 7 to thereby realize the display of predetermined images.

In the case where the panel 1 is enlarged and its outer surface 1*a* made flatter to satisfy consumer demand for larger screen size and improved picture quality, a configuration as described below is used to minimize damage from outside shocks and allow for favorable operation.

Namely, referring to FIG. 4, which is used to describe the radius of curvature of the aperture area 13*b* of the shadow mask 13, a front surface of the shadow mask 13 is curved satisfying the conditions outlined below to realize the configuration as mentioned above.

$$100\% < RMV'/RMV < 110\%$$

$$120\% < RMS/RMV' < 150\%$$

Where RMV is a vertical radius of curvature of the aperture area 13*b* with respect to a vertical direction V (shown in FIG. 4) passing through a center C of an effective screen (i.e., a center C of the aperture area 13*b*), RMS is a vertical radius of curvature with respect to a short side 14 of the aperture area 13*b* corresponding to a short side of the effective screen of FIG. 1, and RMV' is a vertical radius of curvature of the aperture area 13*b* with respect to a vertical direction V at a predetermined location on a horizontal axis passing through center C of aperture area 13*b*.

Figure 4:
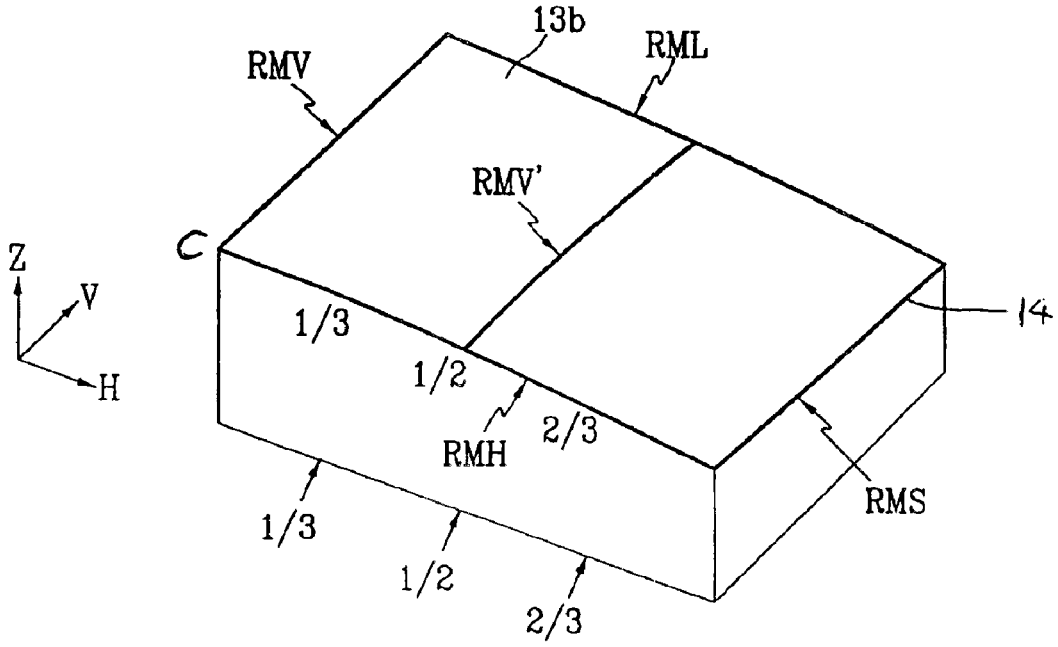
FIG. 4 is a schematic view used to describe a radius of curvature of an aperture area of a shadow mask according to one embodiment of the present invention.

For convenience, FIG. 4 illustrates only one-fourth of the aperture area 13*b* of the shadow mask 13. Also in the drawing, RMH indicates a horizontal radius of curvature of the aperture area 13*b* that passes through a center of the aperture area 13*b* in the horizontal direction, and RML indicates a horizontal radius of curvature with respect to a long side of the aperture area 13*b*.

The above conditions of the aperture area 13*b* of the shadow mask 13 were derived after multiple simulations and much experimentation. That is, it was determined through such simulations and experimentation by the inventor that the shadow mask 13 best withstands outside shocks when meeting the above criteria.

Figure 5:
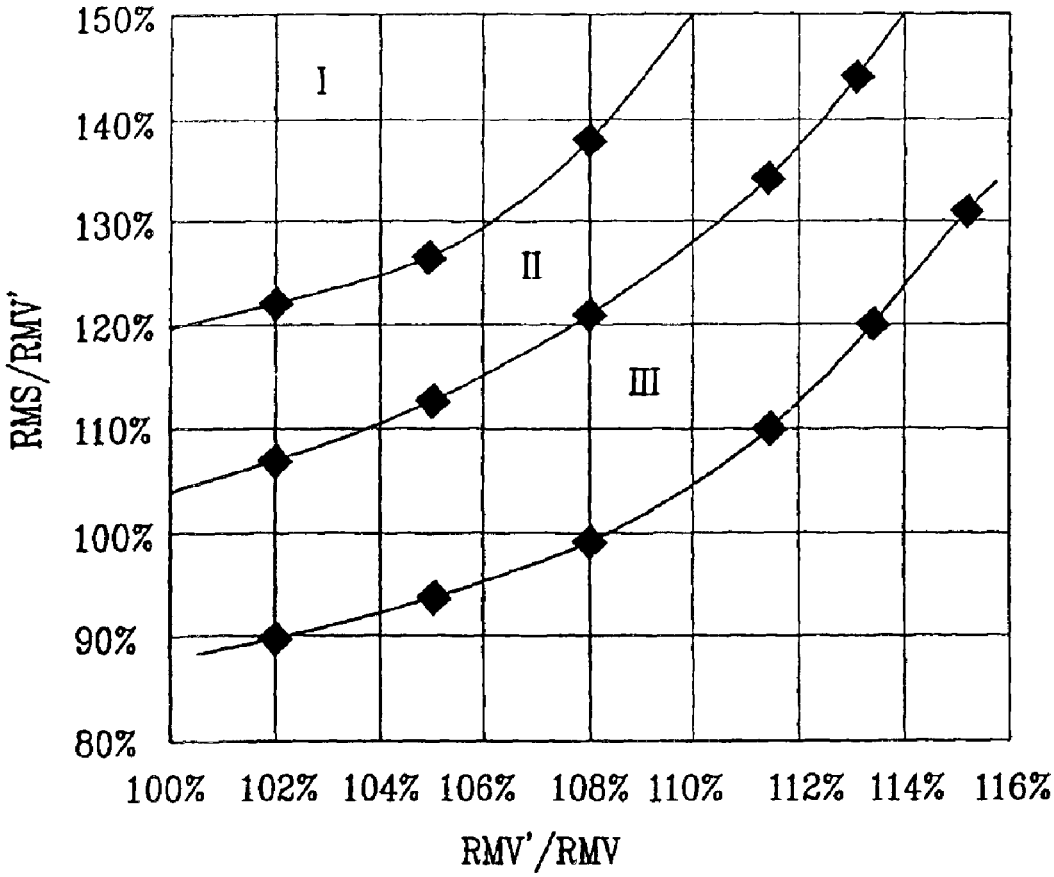
FIG. 5 is a graph showing a relation between a radius of curvature of an aperture area of a shadow mask and a shock value according to one embodiment of the present invention.

FIG. 5 is a graph showing the relation between G-values and a curvature ratio with respect to the aperture area 13*b* of the shadow mask 13. The results of the graph were obtained through experimentation. G-value is the amount of shock applied when the shadow mask 13 is dropped from a predetermined height (typically 30 cm). This value is generally calculated as shown in the equation below. In the CRT industry, it is determined that the greater the G-value is, the safer the design of the shadow mask becomes.

$$\text{G-value}=1\ G\times(\text{drop time}/\text{stopping time})\times n$$

where $n \approx 2.2$.

In the graph of FIG. 5, with regards to the aperture area 13*a*, when the ratio RMV'/RMV is greater than 100% and less than 110%, and the ratio RMS/RMV' is greater than 120% and less than 150% (group I in the drawing), the G-value is greater than or equal to 15 G. On the other hand, in the case where the radius of curvature with respect to the aperture area 13*a* has values that do not satisfy the conditions as outlined above, groups II and III result in which the shadow mask 13 of group II has a G-value of 10–15 G, while the shadow mask 13 of group III has a G-value of 10 G or less. That is, the shadow mask 13 of groups II and III have G-values that are less than the example of the present invention.

In the present invention, using a horizontal length from a center (0) of the aperture area 13*b* to an end of the short side of the aperture area 13*b* as a basis, RMV' is positioned at a specific location between a ⅓ point and a ⅔ point of this horizontal length from the center (0) of the aperture area 13*b* to the edge of the same. In one of the present invention, RMV' is positioned at substantially the ½ (mid) point to apply its vertical radius of curvature at this location.

Further, in FIG. 5, characteristics of a shadow mask applied to a CRT having a picture ratio of 4:3 and a 29-inch screen size are shown. At this time, RMV is 1986 mm, RMV' is 2109 mm, and RMS is 2647 mm such that RMV'/RMV is 106% and RMS/RMV' is 126%.

With limitations placed on the different radii of curvature as described above, the shadow mask is able to better withstand outside shock, even when applied to a CRT that is made to a large size and having a front surface of a panel that is flat. Therefore, deformation or vibration of the shadow mask is prevented to thereby improve the overall quality of the CRT.

Further, in the CRT of the present invention, the glass forming the panel can exhibit contrast characteristics required by the CRT without the use of a separate element with respect to the panel. Manufacture is made simple as a result such that productivity is increased and unit costs are minimized.

Although some embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

For example, the shadow mask is not limited to a CRT with a 29-inch screen size as described above, and different screen sizes such as a 34-inch screen size may be used. With such a screen size, RMV is 2189 mm, RMV' is 2298 mm, and RMS is 2816 mm such that RMV'/RMV is 105% and RMS/RMV' is 123%.

Further, in addition to the 4:3 picture ratio described above, a 16:9 picture ratio, for example, for a wide CRT may be used.

What is claimed is:

1. A shadow mask for a cathode ray tube, comprising:

an aperture area including a plurality of apertures through which electron beams pass, the aperture area having a front surface, a center, and a circumference;

a non-aperture area extending a predetermined distance from the circumference of the aperture area; and a skirt formed extending a predetermined distance from an outer circumference of the non-aperture area at a predetermined angle to the aperture area and the non-aperture area, wherein the front surface of the aperture area satisfies the following conditions, $$100\% < RMV'/RMV < 110\%$$

$$120\% < RMS/RMV' < 150\%$$

where RMV is a vertical radius of curvature of the front surface of the aperture area with respect to a vertical direction passing through a center of the aperture area, RMS is a vertical radius of curvature of the front surface of the aperture area with respect to a short side of the aperture area, and RMV' is a vertical radius of curvature of the front surface of the aperture area with respect to the vertical direction at a location on a horizontal axis passing through the center of the aperture area.

2. The shadow mask of claim 1, wherein, using a horizontal length from the center of the aperture area to an end of the short side of the aperture area as a basis, the vertical radius of curvature RMV' is positioned at a specific location between a ⅓ point and a ⅔ point of this horizontal length from the center of the aperture area to the end of the short side of the aperture area.

3. The shadow mask of claim 2, wherein the vertical radius of curvature RMV' is positioned at substantially mid point with respect to the horizontal length.

4. A cathode ray tube, comprising:

a panel with an outer surface that is substantially flat, an inner surface that is curved, and a phosphor screen being formed on the inner surface;

a funnel connected to the panel and including a deflection yoke that is mounted to its outer circumference;

a neck connected to the funnel and including an electron gun that is mounted therein, the electron gun generating electron beams; and a shadow mask positioned inwardly from the panel and performing color separation of the electron beams emitted from the electron gun, the shadow mask including an aperture area having formed therein a plurality of apertures through which electron beams pass, the aperture area having a front surface, a center, and a circumference, a non-aperture area extending a predetermined distance from a circumference of the aperture area, and a skirt formed extending a predetermined distance from an outer circumference of the non-aperture area at a predetermined angle to the aperture area and the non-aperture area, wherein the front surface of the aperture area of the shadow mask is formed satisfying the following conditions, $$100\% < RMV'/RMV < 110\%$$

$$120\% < RMS/RMV' < 150\%$$

where RMV is a vertical radius of curvature of the front surface of the aperture area with respect to a vertical direction passing through a center of the aperture area, RMS is a vertical radius of curvature of the front surface of the aperture area with respect to a short side of the aperture area, and RMV' is a vertical radius of curvature of the front surface of the aperture area with respect to the vertical direction at a location on a horizontal axis passing through the center of the aperture area.

5. The cathode ray tube of claim 4, wherein, using a horizontal length from a center of the aperture area to an end of the short side of the aperture area as a basis, the vertical radius of curvature RMV' is positioned at a location between a ⅓ point and a ⅔ point of the horizontal length from the center of the aperture area to the end of the short side of the aperture area.

6. The cathode ray tube of claim 5, wherein the vertical radius of curvature RMV' is positioned at substantially half point with respect to the horizontal length.

* * * * *